United States Patent [19]

Nakagawa et al.

[11] Patent Number: 4,694,224

[45] Date of Patent: Sep. 15, 1987

[54] LIGHTING APPARATUS FOR AN ELECTRIC DISCHARGE LAMP

[75] Inventors: Hisato Nakagawa, Ryugasaki; Hideo Kuwahara, Funabashi; Atsuo Koyama, Nagareyama; Mitsuo Akatsuka, Chiba, all of Japan

[73] Assignee: Hitachi Lighting, Ltd., Tokyo, Japan

[21] Appl. No.: 662,944

[22] Filed: Oct. 19, 1984

[30] Foreign Application Priority Data

Oct. 19, 1983 [JP] Japan ..... 58-194226

[51] Int. Cl.[4] ..... H05B 37/02

[52] U.S. Cl. ..... 315/177; 315/178; 315/179; 315/219; 315/DIG. 7; 331/113 A; 331/62

[58] Field of Search ..... 315/239, 247, 248, 176–180, 315/219, DIG. 7; 331/113 A, 62

[56] References Cited

U.S. PATENT DOCUMENTS

| | | | |
|---|---|---|---|
| 2,300,429 | 11/1942 | Meacham | 331/62 |
| 3,566,199 | 2/1971 | Kolster | 331/62 |
| 3,863,125 | 1/1975 | Tollrian et al. | 331/62 |
| 4,005,335 | 1/1977 | Perper | 331/62 |
| 4,045,711 | 8/1977 | Pitel | 331/113 A |
| 4,051,445 | 9/1977 | Boschert | 331/113 A |
| 4,189,685 | 2/1980 | Doss | 331/62 |

FOREIGN PATENT DOCUMENTS

| | | | |
|---|---|---|---|
| 48-15978 | of 1973 | Japan . | |
| 54-3313 | of 1979 | Japan . | |
| 0148406 | 9/1982 | Japan | 331/62 |

*Primary Examiner*—David K. Moore
*Assistant Examiner*—Michael Razavi
*Attorney, Agent, or Firm*—Antonelli, Terry & Wands

[57] ABSTRACT

A lighting apparatus for an electric discharge lamp includes a lighting ballast capacitor connected in series to an electric dicharge lamp for stabilizing a lighting current to the lamp; a preheating ballast capacitor connected in parallel to the lamp for supplying a preheating electric power to the lamp; electric power supply including an output transformer for supplying an electric power to the lighting ballast capacitor; a control electric power supply circuit for obtaining a control electric power through the lighting ballast capacitor and discharge lamp or the preheating ballast capacitor without adding a stepdown transformer or a resistive element for voltage drop; and an oscillator which receives the control electric power from the control power supply circuit and controls the electric power supply. With this lighting apparatus, the electric power loss is made small and the miniaturization of the apparatus can be realized.

20 Claims, 10 Drawing Figures

LIGHTING APPARATUS FOR AN ELECTRIC DISCHARGE LAMP

BACKGROUND OF THE INVENTION

The present invention relates to a lighting apparatus for an electric discharge lamp which operates to energize the electric discharge lamp and, more particularly, to a circuit arrangement of a lighting apparatus for an electric discharge lamp which is suitable to drive the lamp with a high efficiency.

In a lighting apparatus for an electric discharge lamp having a separately excited inverter apparatus which is equipped with an oscillating section and converts a DC electric power to an AC electric power by the output of this oscillating section, the power supply to this oscillating section is generally obtained by a method whereby level of the AC power is reduced to the voltage level that is needed for the oscillating section by a stepdown transformer and then it is rectified by a full wave rectifier. However, in this method, the stepdown transformer and full wave rectifier are necessary to obtain the power for the oscillating section, so that there is a drawback such that the circuit scale is large and expensive. There is another method whereby such a power is directly derived through a resistor after the AC power is rectified. However, this method has drawbacks such that the resistance value becomes large when the voltage is high and the electric power which is consumed by the resistor increases.

In addition, in a separately excited inverter apparatus, the lighting electric power is continuously supplied irrespective of the lighting state of the electric discharge lamp since the oscillating section continuously operates during the time interval when the power supply is turned on. The continuation of operation of such an inverter apparatus causes the light electric power generated to be consumed in vain and also causes a high voltage to be developed while the discharge lamp is lit off.

On the other hand, as a lighting apparatus for an electric discharge lamp having a self-excited inverter apparatus equipped with a base feedback winding, there have been proposed an apparatus in which no oscillation occurs even when the power supply is turned on in the case where the electric discharge lamp is removed, and an apparatus which stops the oscillation in the case where the preheating electrode is disconnected. These apparatuses are disclosed in Japanese Utility Model Publication Laid-open No. 15978/73 and Japanese Patent Publication Laid-open No. 3313/79, etc. However, with these arrangements, in a case where the oscillation has once started, the oscillation does not stop even if the discharge lamp is removed after the light-up or even if the discharge lamp is lit off due to the disconnection of the preheating electrode. Also, although it is possible to detect the defective assembly and disconnection of the preheating electrode of one discharge lamp, the defective assembly and disconnection of the other preheating electrode cannot be detected, so that the service life of the lamp will have been shortened and the unstable operation will have been continued, and the like. Therefore, the conventional lighting apparatuses still have various problems left that have to be solved.

SUMMARY OF THE INVENTION

It is an object of the present invention to obtain the necessary control electric power by supplying the electric power through an electric discharge lamp to an oscillating section of a separately excited inverter circuit without using a stepdown transformer or a resistive element for voltage drop, thereby reducing the loss of electric power by the circuit itself of a lighting apparatus for an electric discharge lamp and to realize the miniaturization and high efficiency of the lighting apparatus for an electric discharge lamp.

Another object of the invention is to provide a lighting apparatus for an electric discharge lamp which can immediately stop the operation when the discharge lamp is removed or when abnormality such as disconnection of a preheating electrode or the like occurs in the lighting circuit.

The present invention relates to a lighting apparatus for an electric discharge lamp comprising a lighting ballast element, connected in series to an electric discharge lamp, for stabilizing a lighting current to the discharge lamp; a preheating ballast element, connected in parallel to the discharge lamp, for supplying a preheating electric power to the discharge lamp; electric power supply means for supplying an electric power to the lighting ballast element; a control power supply circuit for obtaining a control electric power through the lighting ballast element and discharge lamp or the preheating ballast element connected in parallel to the discharge lamp without, in particular, adding a stepdown transformer or a resistive element for voltage drop; and an oscillator which receives the control electric power from the control power supply circuit and controls the electric power supply means, thereby making the electric power loss small and realizing the miniaturization.

BRIEF DESCRIPTION OF THE DRAWING

The present invention will be apparent from the following detailed description taken in conjunction with the accompanying drawings, in which.

DESCRIPTION OF THE PREFERRED EMBODIMENTS

Figure 1:
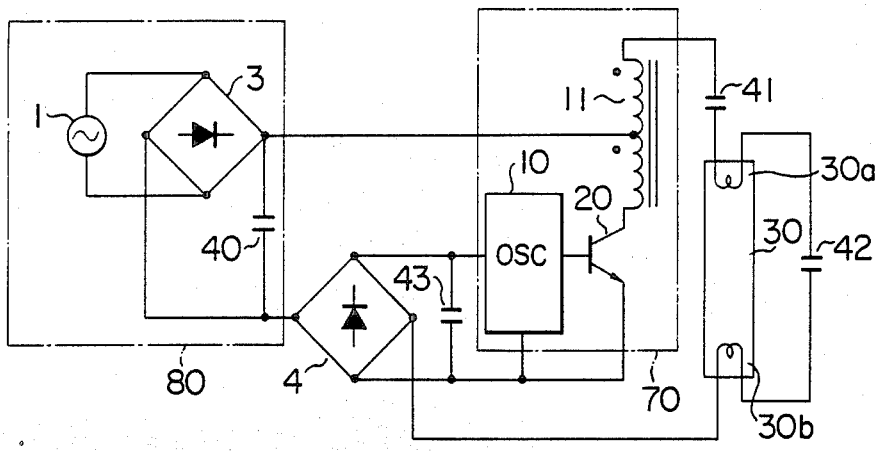
FIG. 1 is a circuit diagram showing a fundamental embodiment of the present invention, in which a control power supply circuit is constituted as a full wave rectifier.

One embodiment of the present invention will now be described hereinbelow with reference to FIG. 1. A reference numeral 3 denotes a full wave rectifier connected to an AC power supply 1 for commercial use, and 40 is a capacitor connected between the output terminals of the full wave rectifier 3 and consitutes a DC power supply 80. A numeral 11 is an output transformer whose center tap is coupled to one end of the capacitor 40. One end of the winding of the output transformer 11 is connected to the collector of a transistor 20. The other end of the winding of the output transformer 11 is connected to one preheating electrode 30*a* of an electric discharge lamp 30 such as a fluorescent lamp through a ballast capacitor 41 as a ballast element for light-up. In addition, the preheating electrode 30*a* is connected to the other preheating electrode 30*b* through a preheating capacitor 42 as a preheating ballast element. The output terminal of the full wave rectifier 3 is connected to one input terminal of a full wave rectifier 4. The preheating electrode 30*b* is further connected to the other input terminal of the full wave rectifier 4. A numeral 43 is a capacitor connected between the output terminals of the full wave rectifier 4, and 10 is an oscillator constituting a part of an inverter circuit 70. The oscillator 10 uses an output electric power of the full wave rectifier 4 as a control power source. The output signal of repetitive width pulses of the oscillator 10 is inputted to the base of the main oscillating transistor 20. Lastly, the emitter of the transistor 20 is connected to the output terminal of the full wave rectifier 4.

Next, the operation of the lighting apparatus for an electric discharge lamp constituted in this way will be explained. First, when the AC power supply 1 is turned on, the current rectified by the full wave rectifier 3 is charged in the capacitor 40 and is charged in the capacitor 43 through the output transformer 11, ballast capacitor 41, preheating electrode 30*a* of the discharge lamp 30, preheating capacitor 42, the other preheating electrode 30*b* of the discharge lamp 30, and full wave rectifier 4. When the voltage across the capacitor 43 increases to the operating voltage of the oscillator 10, the oscillator 10 starts oscillating, thereby making the transistor 20 operative. As the result of the operation of the transistor 20, the current is supplied to the output transformer 11. The current flows from the output transformer 11 through the ballast capacitor 41, preheating electrode 30*a* of the discharge lamp 30, preheating capacitor 42, preheating electrode 30*b* of the discharge lamp 30, full wave rectifier 4, and capacitor 43. The preheating electrodes 30*a* and 30*b* of the discharge lamp 30 are preheated due to this current flow, and at the same time the control electric power which is enough to allow the oscillator 10 to operate stably is supplied to the oscillator 10. Further, when the preheating electrodes 30*a* and 30*b* of the discharge lamp 30 are preheated and the voltage developed across the preheating capacitor 42 is simultaneously applied to both ends of the discharge lamp 30, the discharge lamp 30 is lit after the preheating electrodes 30*a* and 30*b* were sufficiently preheated. When the discharge lamp 30 has been lit the DC electric power is supplied to the oscillator 10 through the output transformer 11, ballast capacitor 41, discharge lamp 30, and full wave rectifier 4; therefore, the stable oscillation can be continued.

In this way, according to this embodiment, since there is no need to add a particular circuit for dropping the power supply voltage in order to supply the control electric power to the oscillator 10, the electrical circuit section can be made small and there is also an effect such that the electric power loss can be made small since the control electric power can be supplied to the oscillator 10 without passing through a resistor. Further, in this embodiment, the control electric power is all supplied through the discharge lamp 30 to the oscillator 10; consequently, when the discharge lamp 30 is removed from the circuit, the supply of the control power to the oscillator 10 completely stops, thereby enabling the oscillation to be certainly stopped. In addition, no control power is supplied to the oscillator 10 even when the AC power source 1 is applied to the inverter circuit in the state whereby the discharge lamp 30 is not connected to the circuit or whereby either one of the preheating electrodes 30*a* and 30*b* of the discharge lamp 30 is disconnected. Therefore, the oscillator 10 does not oscillate and the inverter circuit 70 is held stopped. Thus, this embodiment has an effect such that the loadless state in that an excessive burden is imparted to the circuit element does not exist.

Figure 2:
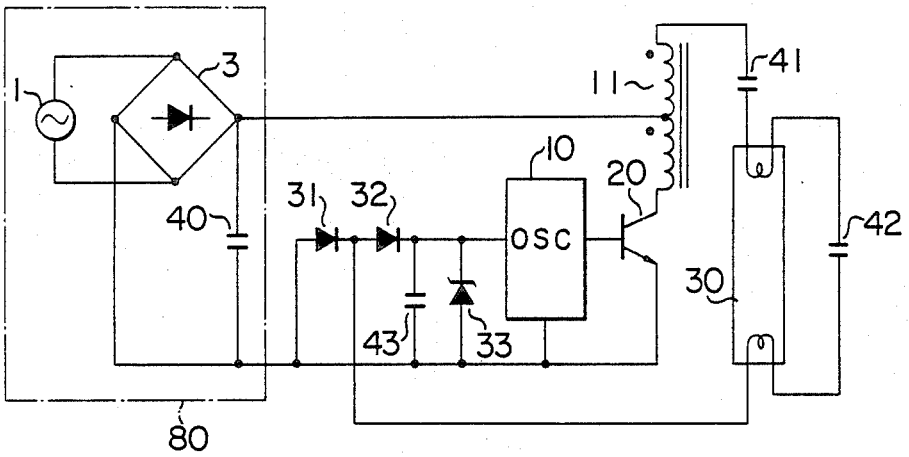
FIG. 2 is a circuit diagram also showing a fundamental embodiment of the invention, in which the control power supply circuit is constituted as a half wave rectifier.

The full wave rectifier 4 in the embodiment of FIG. 1 serves to rectify the current which is supplied to the oscillator 10 through the discharge lamp 30. This rectifier 4 may be substituted by a half wave rectifier consisting of diodes 31 and 32 which are connected in series in the same direction as shown in FIG. 2. In addition, as shown in FIG. 2, when a Zener diode 33 is connected in parallel to the capacitor 43 as shown in FIG. 2, the voltage across the capacitor 43 becomes stable at the voltage level that is determined by the Zener voltage of the Zener diode 33, so that it is possible to supply to the transistor 20 the base signal which repeats at a constant period irrespective of the variation in power supply voltage.

Figure 3:
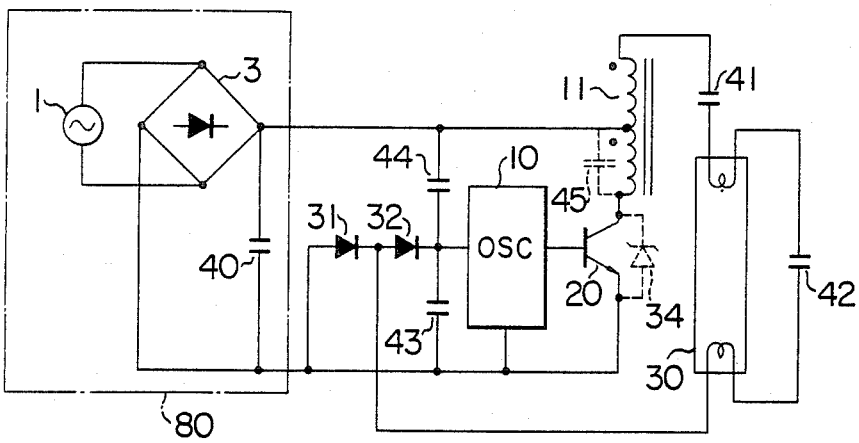
FIG. 3 is also an improved circuit diagram of the embodiment.

As shown in FIG. 3, when a capacitor 44 is connected between the plus terminal of the full wave rectifier 3 and the power supply input terminal of the oscillator 10, the control electric power is supplied to the oscillator 10 through the output transformer 11, ballast capacitor 41, discharge lamp 30, preheating capacitor 42, and diode 32 and also through the capacitor 44 at the time of turn-on of the AC power supply 1. Thus, this makes it possible to allow the start-up of the oscillator 10 to be certainly performed. When the oscillator 10 has once started operating, the amount of power source current that is supplied through the capacitor 44 to the oscillator 10 decreases because the full wave rectifier 3 outputs the DC voltage and the impedance of the capacitor 44 increases. Thus, almost all of the power source current is supplied to the oscillator 10 through the output transformer 11, ballast capacitor 41, discharge lamp 30, preheating capacitor 42, and diode 32.

In the case where the discharge lamp 30 is removed from the circuit when the inverter 70 is operating in the embodiment of FIG. 1, a high voltage is developed between the collector and emitter of the transistor 20 due to the electromagnetic energy stored in the output transformer 11. Therefore, a transistor having a high withstanding voltage is needed as the transistor 20. Thus, in order to allow a transistor having a low withstanding voltage to be used as the transistor 20, it is also possible to constitute a circuit such that an avalanche diode 34 is connected between the collector and emitter of the transistor 20 as indicated by a broken line in FIG.

3 and the electromagnetic energy of the output transformer 11 is absorbed by this avalanche diode 34. On the other hand, in place of connecting the avalanche diode 34, it is also possible to connect a capacitor 45 between the center tap of the output transformer 11 and the transistor 20 as likewise indicated by the broken line, thereby to absorb the electromagnetic energy of the output transformer 11.

Figure 4:
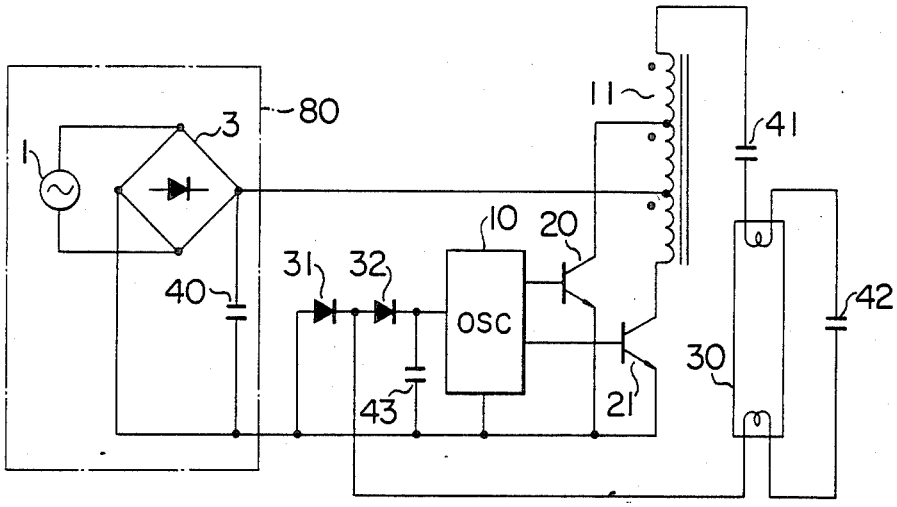
FIG. 4 shows an example of a circuit using two transistors which are alternately turned on and off.

As shown in FIG. 4, with respect to the circuit in which the transistors 20 and 21 are alternately turned on and off as well, if the circuit is constituted such that the control power is supplied to the oscillator 10 through the output transformer 11, ballast capacitor 41, discharge lamp 30, preheating capacitor 42, and diode 32, there will be no need to add a circuit to supply the control power to the oscillator 10 and the electric power loss of the circuit can be also made small.

Figure 5:
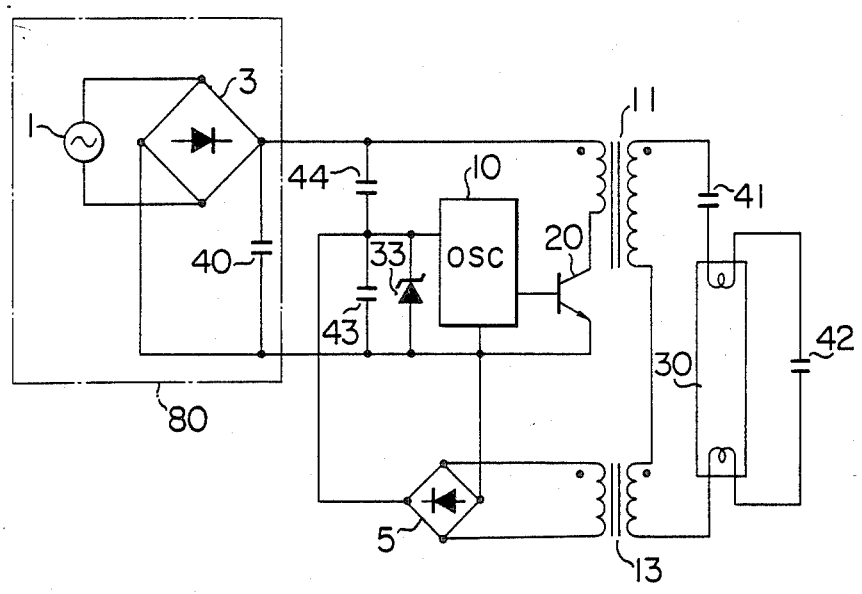
FIG. 5 shows an example of a circuit in the case where an output transformer of the insulating type is used.

In the foregoing embodiment, the output transformer is constituted by the autotransformer having no secondary winding. However, in the case where the insulating type output transformer is used, as shown in FIG. 5, the control electric power may be supplied to the oscillator 10 through the capacitor 44 when the AC power supply 1 is turned on and after the oscillation started, the control power may be supplied through the output transformer 11, ballast capacitor 41, discharge lamp 30, preheating capacitor 42, and a feedback transformer 13 and then through a full wave rectifier 5.

Figure 6:
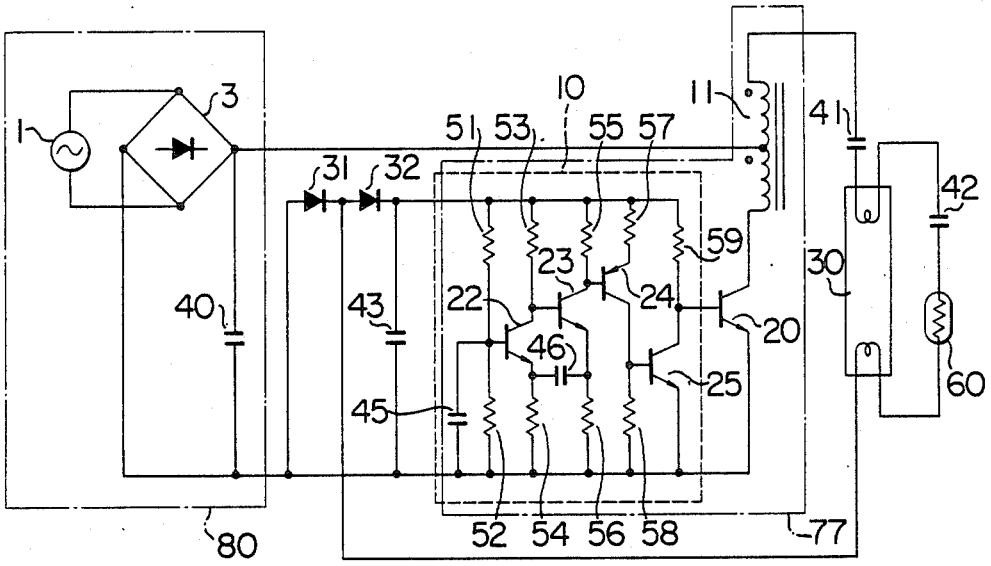
FIG. 6 shows an example of a circuit in which an oscillating circuit is constituted using an emitter-coupled stable multivibrator.

Next, FIG. 6 shows a lighting apparatus for an electric discharge lamp whereby an emitter-coupled stable multivibrator using a transistor is used in the oscillator 10 and a positive characteristic thermistor 60 is connected in series to the preheating capacitor 42. In such an apparatus, it is assumed that in spite of the fact that an inverter circuit 77 started oscillating due to the turn-on of the AC power supply 1, the discharge lamp 30 does not change to the lighting state for to some reason but holds the preheating state. Due to the continuation of the preheating state, the resistance value of the positive characteristic thermistor 60 increases due to the self-exothermic since the preheating current flows through the thermistor 60. The voltage across the capacitor 43, which is the power supply voltage of the oscillator 10, decreases with an increase in that resistance value. When the voltage across the capacitor 43 decreases and therefore the voltage across a resistor 52 becomes a voltage less than the base-emitter voltage at which the transistor 22 can operate, the transistor 22 cannot be driven; consequently, the oscillator 10 stops oscillating and the inverter circuit 77 stops. In this way, if the circuit which stops the oscillation in association with the reduction of the power supply voltage is used in the oscillator 10, the oscillating operation of the oscillator 10 can be stopped by reducing the power supply current without cutting the power supply current to the oscillator 10, thereby enabling the operation of the discharge lamp inverter to be stopped.

According to the above-described embodiment, there is no need to provide a circuit to reduce the level of the power supply voltage to the voltage level necessary for the oscillator in order to supply the power source to the oscillator. Also, the electric power loss that is necessary for the voltage stepdown can be made small. Therefore, miniaturization and high efficiency of the lighting apparatus for an electric discharge lamp can be realized.

In addition, according to the foregoing embodiment, the operation of the inverter for the discharge lamp can be stopped by removing the discharge lamp from the circuit, so that a high voltage is not generated in the discharge lamp socket and safety is assured. When the discharge lamp is not connected to the circuit or when the preheating electrode of the discharge lamp is disconnected, the circuit is not made operative, so that the electric power is not consumed in vain. Further, since the circuit does not operate in the loadless state whereby an excessive burden is imparted to the circuit element, the burden to the circuit element can be reduced.

Figure 7:
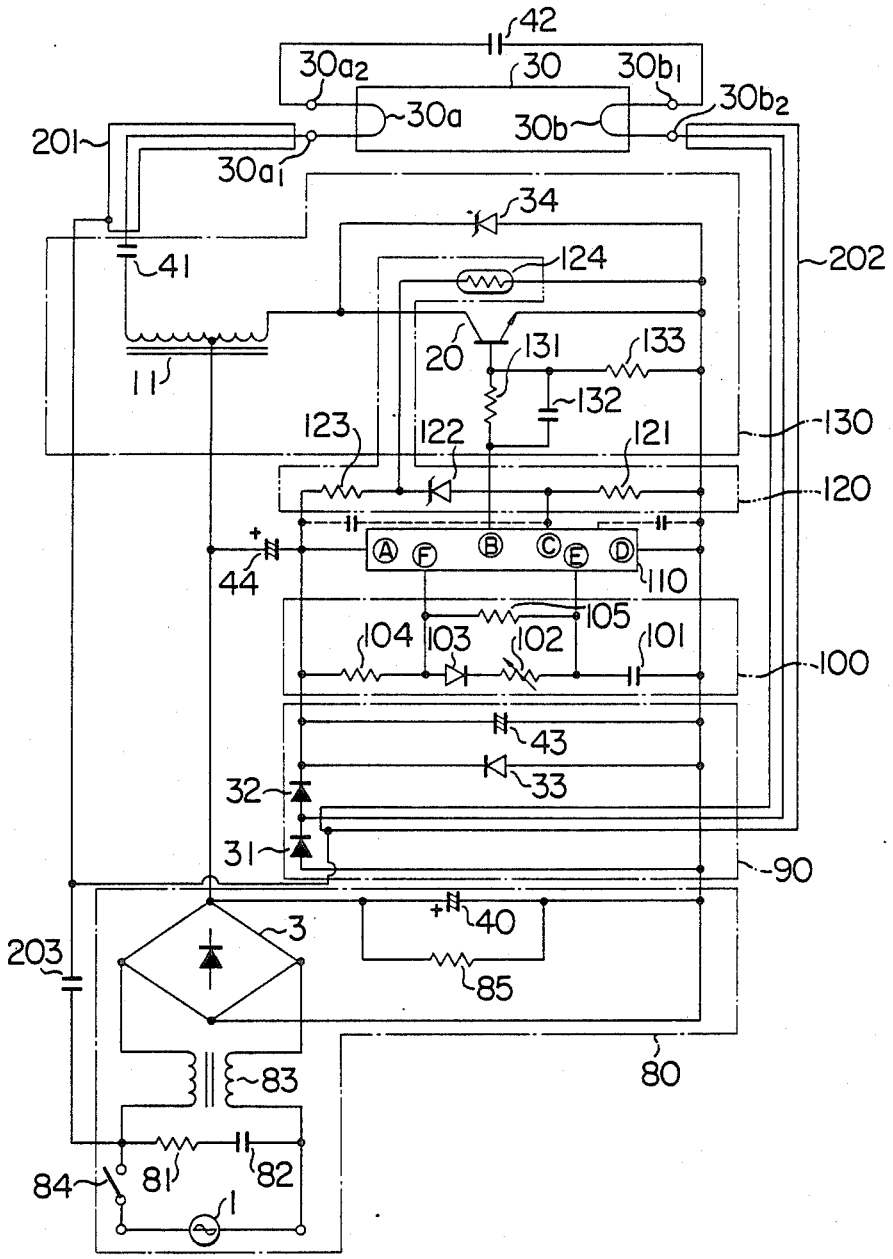
FIG. 7 is a circuit diagram showing an example of a further practical embodiment.

Next, a further practical embodiment shown in FIG. 7 will be explained, in which the same parts and components as those shown in the foregoing embodiment are designated by the same reference numerals and they perform the same functions; therefore, their descriptions are omitted. Further, numerals 81, 82 and 83 denote a resistor, a capacitor and a reactor which together constitute a noise filter; 84 is a power switch; and 85 is a resistor connected in parallel to the capacitor 40. When the power switch 84 is turned off, the resistor 85 serves to discharge the charges stored in the capacitor 40, thereby improving the safety of the circuit. The DC power supply 80 is constituted by rectifying the AC power supply 1 for commercial use. A numeral 110 denotes a semiconductor integrated circuit (e.g., NE555 made by Signetics, Co. Ltd., or the like) for a timer equipped with a voltage comparator, SR flip flop circuit, etc. therein. In the embodiment, the oscillator is constituted using the semiconductor integrated circuit 110 as a principal component. Numerals 31 and 32 are the diodes to feed back the control electric power to the oscillating element 110 consisting of the semiconductor integrated circuit. In the embodiment, a low voltage is supplied to the diodes 31 and 32 through the discharge lamp 30. Numerals 33 and 43 are a Zener diode and a capacitor to stabilize the electric power which is supplied to the oscillating element 110 and these elements constitute a control power supply circuit 90 of the oscillating circuit. A numeral 100 is an oscillation time constant circuit to determine the oscillating condition (operational condition) of the oscillating element 110 and comprises the following elements. Namely, one end of a capacitor 101 is connected to a threshold terminal E of the oscillating element 110. Resistors 102 and 105 are connected between the threshold terminal E and a discharge terminal F of the oscillating element 110. Also, a diode 103 is connected in series to the resistor 102, thereby making the conditions for charge and discharge into and from the capacitor 101 different. Further, a resistor 104 is connected between the discharge terminal F and the operating power supply. A power terminal A of the oscillating element 110 is connected to the operating power supply, while an earth terminal D is connected to a grouding electrode side of the DC power supply 80, respectively. A numeral 120 is a temperature protecting circuit to detect overheating of the transistor 20 and to stop the operation of the oscillating element 110. Namely, the temperature protecting circuit 120 utilizes a reset terminal C of the oscillating element 110 and a series circuit consisting of a resistor 123, a Zener diode 122 and a resistor 121 is connected between the power terminal A and the grounding terminal D of the oscillating element 110. The node of the resistor 123 and Zener diode 122 is connected tc the grounding terminal D through a thermistor 124. The node of the Zener diode 122 and resistor 121 is connected to the reset terminal C of the oscillating element 110. An output terminal B of the oscillating element 110 is connected to the base of the transistor 20 through a capacitor 132 for improvement of the waveform and through a resistor 131. A resistor 133 is for the base bias of the transistor 20. Numerals 201 and 202 are shielding wires which constitute the current feeding line for supplying a high frequency AC electric power of the lighting circuit for the electric discharge lamp 30. The shields of these shielding wires are grounded through an earth capacitor 203.

On the other hand, the output transformer 11 consisting of the autotransformer and the transistor 20 as the switching element constitute electric power supply means 130 for converting the DC electric power to the high frequency AC electric power. In addition, one end of the ballast capacitor 41 for light-up is connected to one end $30a_1$ of the preheating electrode 30*a* of the discharge lamp 30 having a pair of preheating elements; the ballast capacitor 42 for preheating is connected between the other end $30a_2$ of the preheating electrode 30*a* and one end $30b_1$ of the other preheating electrode 30*b*; further, the other end $30b_2$ of the preheating electrode 30*b* is connected to the negative electrode side of the DC power supply 80 through the control power supply circuit 90, respectively; and thereby constituting the lighting circuit for the discharge lamp 30. At this time, it is also possible to regard the control power supply circuit 90 as the converter for converting the lighting current which flows through the lighting circuit to the voltage signal and to regard the oscillating element 110 as the power control circuit which receives the voltage signal from the converter and controls the electric power supply means 130.

The operation of the circuit according to the embodiment constituted as described above will now be simply explained. When the AC power supply 1 is turned on, the DC electric power is fed to the oscillating element 110 through the full wave rectifier 3 and capacitor 44, so that the oscillating element 110 immediately starts the time operation and sets the output thereof into a Hi level. This makes the transistor 20 conductive. The capacitor 101 is charged through the resistors 104, 102 and 105. When this charge voltage reaches a reference voltage, the oscillating element 110 completes the time operation and sets the output thereof into a Lo level. At the same time, the charges stored in the capacitor 101 are discharged through the resistor 105 and discharge terminal F. When the charges in the capacitor 101 are discharged, the charging operation of the capacitor 101 is restarted, so that the output of the oscillating element 110 is set into a Hi level. Namely, by assembling the diode 103 in the charging/discharging circuit of the capacitor 101, it is possible to obtain from the oscillator the width pulse signal as shown in FIG. 8 whereby the interval A when the output is at a Hi level and the interval B when the output is at a Lo level are repeated at irregular intervals.

Figure 8:
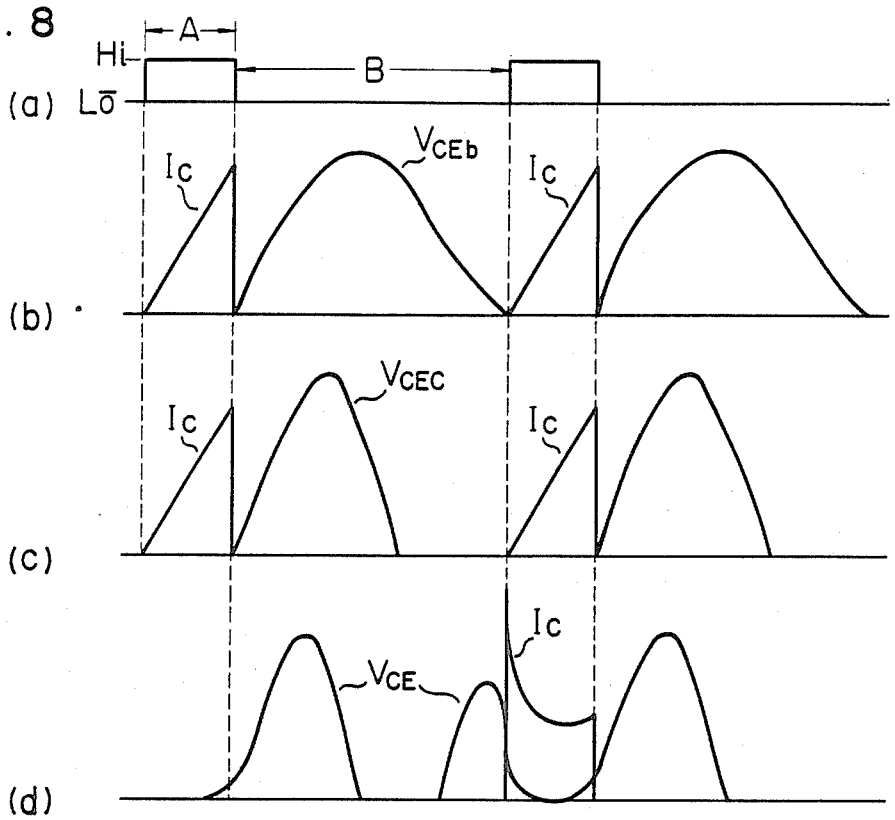
FIG. 8 shows waveform diagrams for explaining the circuit operation.

In addition, in FIG. 8, (a) denotes an output signal of the oscillator and (b) and (c) respectively represent a switching current Ic and a resonance voltage Vce at the lighting and preheating times. First, when the DC electric power is supplied, the oscillator starts the oscillating operation and holds its output signal at a Hi level during the predetermined interval A. Thus, the switching current Ic flows into the transistor 20 through the output transformer 11. When the output signal of the oscillator becomes a Lo level (this interval is shown by the interval B) after the elapse of the interval A, the switching current Ic of the transistor 20 is shut off, so that this causes the series resonance due to the output transformer 11 and time constant of each ballast element 41 (or 42) connected in series thereto. Namely, while the lamp is in the lighting state ((b) in the diagram), the series resonance that is determined by the output transformer 11 and time constant due to the ballast capacitor 41 (the resonance voltage waveform is indicated by Vceb) occurs, so that the lighting current in association with this series resonance flows through the output transformer 11, ballast capacitor 41 and discharge lamp 30. On the other hand, during the preheating state ((c) in the diagram), the series resonance that is determined by the output transformer 11 and time constant due to the ballast capacitor 41 and preheating capacitor 42 (the resonance voltage waveform is indicated by Vcec) occurs, so that the preheating current in association with this series resonance flows through the output transformer 11, ballast capacitor 41, preheating electrode 30*a* of the discharge lamp 30, preheating capacitor 42, and preheating electrode 30*b*. In this way, the series resonance occurs on the basis of the output signal of the oscillator and the necessary preheating current and lighting current are fed to the electric discharge lamp.

In the embodiment, since the preheating capacitor 42 is connected in series to the ballast capacitor 41 at the preheating time, the resonance frequency thereof becomes higher than that during the lighting state; however, the oscillating period of the oscillator is set to be constant. Thus, even if the resonance frequency increases at the preheating time, the capacity of the preheating capacitor 42 is selected such that the conduction timing of the switching element 20 and the rising timing of the resonance voltage do not overlap. Practically speaking, the circuit constant is selected such that the switching element 20 is made conductive immediately before the second positive leading edge of the resonance voltage at the preheating time. This is because, as shown in FIG. 8(*d*), when the switching element 20 is rendered conductive at the leading time of the resonance voltage, the increasing rate of current of the switching element becomes large, causing a risk of thermal breakdown of the switching element 20.

On the other hand, in the case where each constant is selected such that free oscillation due to the series resonance by the output transformer 11 and ballast capacitors 41 and 42 occurs a plurality of times during the interval when the switching element 20 is off, a higher starting voltage of the discharge lamp 30 can be derived.

Further, in the embodiment, when the temperature of the transistor 20 is low, the resistance value of the thermistor 124 is high and the voltage across the thermistor 124 exceeds the Zener voltage of the Zener diode 122, so that the current flows through the Zener diode 122 and the voltage drop of the resistor 121 is insufficient. Therefore, the reset signal is not supplied to the oscillating element 110 and the oscillating element 110 continues the oscillating operation. On the contrary, when the temperature of the transistor 20 increases, the resistance value of the thermistor 124 decreases and the potential across the thermistor 124 decreases, so that no current flows through the Zener diode 122. Thus, the voltage drop of the resistor 121, i.e., the potential at the reset terminal C becomes low and the reset signal is supplied to the reset terminal C, causing the oscillating element 110 to stop the oscillating operation.

Figure 9:
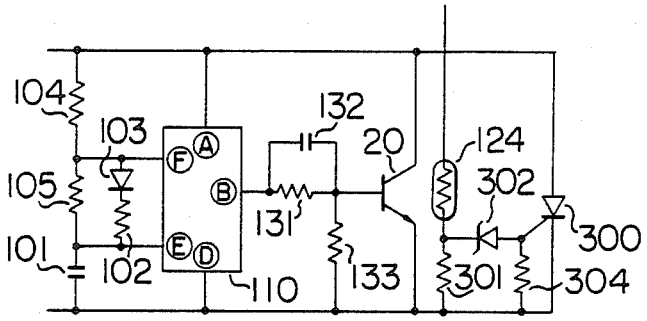
FIG. 9 is a circuit diagram for explaining another embodiment of a temperature protecting circuit.
Figure 10:
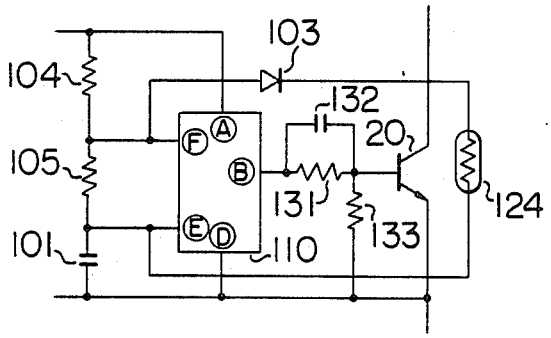
FIG. 10 is a circuit diagram showing an example of further another temperature protecting circuit.

Other embodiments of the temperature protecting circuit will now be explained with reference to FIGS. 9 and 10. FIG. 9 shows an example whereby the increase in temperature of the transistor 20 is detected by the thermistor 124 and a thyristor 300 is made conductive, thereby short-circuiting the control power supply of the oscillating element 110 and stopping the oscillating operation of the oscillating element 110. FIG. 10 shows an example whereby the thermistor 124 is built in the oscillation time constant circuit and when the increase in temperature of the transistor 20 is detected, the oscillator is controlled such that the ON-interval of the transistor 20 is shortened. In addition, in FIG. 9, the protecting operation can be also similarly performed when the protecting circuit is constituted in the manner such that the reset terminal C of the oscillating element 110 is short-circuited onto the negative polarity side of the DC power supply when the increase in temperature of the transistor 20 is detected by the thermistor 124.

We claim:

1. A lighting apparatus for an electric discharge lamp comprising:

a lighting ballast element, connected in series to an electrice discharge lamp having a pair of preheating electrodes, for stabilizing a lighting current to said discharge lamp;

a preheating ballast element, connected in series with said pair of preheating electrodes of said discharge lamp, for supplying a preheating electrice power to the discharge lamp;

electric power supply means for supplying an electric power to said lighting ballast element;

a control power supply circuit connected to obtain a control electric signal from said electric power supply means through the series circuit of said lighting ballast element and discharge lamp after the lamp has been lighted or through the series circuit of said lighting ballast element, said preheating ballast element and the two preheating electrodes of said discharge lamp when said electric power is supplied to said lighting ballast element to light said lamp; and an oscillator connected to receive said control electric signal from said control power supply circuit for controlling said electric power supply means to supply electric power to said lighting ballast element only while it receives said control electric signal from said control power supply circuit.

2. A lighting apparatus for an electric discharge lamp comprising:

a lighting ballast element, connected in series to an electric discharge lamp having preheating electrodes, for stabilizing a lighting current to said discharge lamp;

a preheating ballast element, connected in series with said preheating electrodes of said discharge lamp, for supplying a preheating electric power to the discharge lamp;

electric power supply means for supplying an electric power to said lighting ballast element;

a control power supply circuit connected to obtain a control electric signal from said electric power supply means through said lighting ballast element and discharge lamp or through said preheating ballast element connected in parallel to said discharge lamp when said electric power is supplied to said lighting ballast element; and an oscillator connected to receive said control electric signal from said control power supply circuit for controlling said electric power supply means to supply electric power to said lighting ballast element only while it receives said control electric signal from said control power supply circuit;

wherein said electric power supply means includes a transformer having a center tap connected to one electrode of a DC power supply and one winding terminal connected to said series circuit of said lighting ballast element and said discharge lamp, and a switching element connected between the other winding terminal of said transformer and the other electrode of said DC power supply, said switching element being connected to said oscillator so as to be controlled thereby.

3. A lighting apparatus according to claim 2 wherein said transformer consists of an auto-transformer having a center tap.

4. A lighting apparatus for an electric discharge lamp comprising:

a lighting ballast element, connected in series to an electric discharge lamp having preheating electrodes, for stabilizing a lighting current to said discharge lamp;

a preheating ballast element, connected in series with said preheating electrode of said discharge lamp, for supplying a preheating electric power to the discharge lamp;

electric power supply means for supplying an electric power to said lighting ballast element;

a control power supply circuit connected to obtain a control electric signal from said electric power supply means through said lighting ballast element and discharge lamp or through said preheating balast element connected in parallel to said discharge lamp when said electric power is supplied to said lighting ballast element; and an oscillator connected to receive said control electric signal from said control power supply circuit for controlling said electric power supply means to supply electric power to said lighting ballast element only while it receives said control electric signal from said control power supply circuit;

wherein said control power supply circuit includes a full wave rectifying bridge circuit in which one end of an AC input terminal thereof is connected to said series circuit of said lighting ballast element and said discharge lamp or said preheating ballast element connected to the discharge lamp, while a DC output terminal is connected to a control power supply input terminal of said oscillator.

5. A lighting apparatus for an electric discharge lamp comprising:

a lighting ballast element, connected in series to an electric discharge lamp having preheating electrodes, for stabilizing a lighting current to said discharge lamp;

a preheating ballast element, connected in series with said preheating electrodes of said discharge lamp, for supplying a preheating electric power to the discharge lamp;

electric power supply means for supplying an electric power to aid lighting ballast element;

a control power supply circuit connected to obtain a control electric signal from said electric power supply means through said lighting ballast element and discharge lamp or through said preheating ballast element connected in parallel to said discharge lamp when said electric power is supplied to said lighting ballast element; and an oscillator connected to receive said control electric signal from said control power supply circuit for controlling said electric power supply means to supply electric power to said lighting ballast element only while it receives said control electric signal from said control power suppoly circuit;

wherein said control power supply circuit includes a half wave rectifier in which two rectifying elements are connected in series in the same direction and the intermediate node of said rectifying elements is connected to said series circuit of said lighting ballast element and asid discharge lamp or said preheating ballast element connected in parallel to the discharge lamp, and a DC output terminal of said half wave rectifier is connected to a control power supply input terminal of said oscillator.

6. A lighting apparatus for an electric discharge lamp comprising:

a lighting ballast element, connected in series to an electric discharge lamp having preheating electrodes, for stabilizing a lighting current to said discharge lamp;

a preheating ballast element, connected in series with said preheating electrodes of said discharge lamp, for supplying a preheating electric power to the discharge lamp;

electric power supply means for supplying an electric power to said lighting balast element;

a control power supply circuit connected to obtain a control electric signal from said electric power supply means through said lighting ballast element and discharge lamp or through said preheating ballast element connected in parallel to said discharge lamp when saId electric power is supplied to said lighting ballast element; and an oscillator connected to receive said control electric signal from said control power supply circuit for controlling said electric power supply means to supply electric power to said lighting ballast element only while it recevies said control electric signal from said control power supply circuit;

wherein said electric power supply means includes an output transformer having a primary winding connected to one electrode of a DC power supply and a secondary winding, one end of said secondary winding being connected to said series circuit of said lighting ballast element and said discharge lamp, and a switching element connected between the primary winding of said output transformer and the other electrode of said DC power supply; and wherein said control power supply includes a further transformer having a primary winding connected between the other end of the secondary winding of said output transformer and asid series circuit of said lighting ballast element and said discharge lamp or said preheating ballast element connected to the discharge lamp, said control power supply circuit being connected to said further transformer for supplying the control electric signal to said oscillator from a secondary winding of said further transformer, and said oscillator being connected to control operation of said switching element.

7. A lighting apparatus according to claim 4, wherein said lighting ballast element consist of a lighting ballast capacitor and said preheating ballast element consists of a preheating ballast capacitor.

8. A lighting apparatus according to claim 5, wherein said lighting ballast element consists of a lighting ballast capacitor and said preheating ballast element consists of a preheating ballast capacitor.

9. A lighting apparatus according to claim 6, wherein said lighting ballast element consists of a lighting ballast capacitor and said preheating ballast element consists of a preheating ballast capacitor.

10. A lighting apparatus according to claim 2, wherein said oscillator includes a flip flop circuit for outputting a pulse signal to the switching element of said electric power supply means at every constant period.

11. A lighting apparatus according to claim 6, wherein said oscillator includes a flip flop circuit for outputting a pulse signal to the switching element of said electric power supply means at every constant period.

12. A lighting apparatus according to claim 10, further comprising an oscillation time constant circuit consisting of a series circuit of a resistive element and a rectifying element and a resistive element connected in parallel to said series circuit, and wherein said oscillator includes means for repeatedly outputting said pulse signal for controlling the controlling the conducting interval so as to be shorter than the turn-off interval of the switching element of said electric power supply means.

13. A lighting apparatus according to claim 11, further comprising an oscillation time constant circuit consisting of a series circuit of a resistive element and a rectifying element and a resistive element connected in parallel to said series circuit, and wherein said oscillator includes means for repeatedly outputting said pulse signal for controlling the conducting interval so as to be shorter than the turn-off interval of the switching element of said electric power supply means.

14. A lighting apparatus for an electric discharge lamp comprising:

a lighting ballast element, one end of which is connected to one end of one preheating electrode of an electric discharge lamp having a pair of preheating electrodes for stabilizing a lighting current supplied to said discharge lamp;

a preheating ballast element, connected between the other end of said one preheating electrode of the discharge lamp and one end of the other preheating electrode of the discharge lamp, for supplying a preheating electric power to the discharge lamp;

electric power supply means consisting of an output transformer which has a center tap connected to one electrode of a DC power supply and one winding terminal of which is connected to the other end of said lighting ballast element connected to the discharge lamp, and a switching element connected between the other winding terminal of said output transformer and the other electrode of said DC power supply;

a control power supply circuit which has a half wave rectifier by which the other end of the other preheating electrode of the discharge lamp is connected to an intermediate node of two rectifying elements connected in series in the same direction, and which obtains a control electric signal through said lighting ballast element and discharge lamp, or through said preheating ballast element connected in parallel to said discharge lamp; and an oscillating circuit connected to receive the control electric signal from said control power supply circuit and to control said electric power supply means to supply power to said electric discharge lamp only while it receives said control electric signal from said control power support circuit.

15. A lighting apparatus according to claim 14, wherein said lighting ballast element consists of a lighting ballast capacitor and said preheating ballast element consists of a preheating ballast capacitor.

16. A lighting apparatus according to claim 14, wherein said electric power supply means has a transistor as said switching element, and wherein said oscillating circuit includes a flip flop circuit for outputting a pulse signal to a base terminal of said transistor of said electric power supply means at every constant period.

17. A lighting apparatus according to claim 16, further comprising an oscillation time constant circuit consisting of a series circuit of a resistive element and a rectifying element and a resistive element connected in parallel to said series circuit, and wherein said oscillating circuit includes means for repeatedly outputted said pulse signal for controlling the conducting interval so as to be shorter than the turn-off interval of the transistor of said electric power supply means.

18. A lighting apparatus according to claim 14, wherein the capacity of said preheating ballast element is such as to cause the resonance once or more times due to the time constants of said output transformer, said lighting ballast element and said preheating ballast element in the turnoff interval of the switching element of said electric power supply means.

19. A lighting apparatus according to claim 18, wherein said oscillating circuit includes means for generating a pulse signal for making the switching element of said electric power supply means conductive for the interval that does not coincide with the increasing interval of the resonance voltage of the free resonance due to the time constants of said output transformer, said lighting ballast element and said preheating ballast element.

20. A lighting apparatus according to claim 16, wherein said oscillating circuit has a thermal sensitive element arranged adjacent to the transistor of said electric power supply means, and a protecting circuit for shutting off the output of the flip flop circuit of said oscillating circuit due to a change in resistance of said thermal sensitive element.

* * * * *